United States Patent [19]

Brickner et al.

[11] 4,351,230

[45] Sep. 28, 1982

[54] SELF-VENTING CARGO CONTAINER

[75] Inventors: Laurence R. Brickner, Marathon, N.Y.; David N. Moutner, Spotswood, N.J.; Barbara J. Pratt, Yorktown Heights, N.Y.

[73] Assignee: Sea-Land Service, Inc., Elizabeth, N.J.

[21] Appl. No.: 255,421

[22] Filed: Apr. 20, 1981

[51] Int. Cl.[3] ..... F24F 7/00

[52] U.S. Cl. ..... 98/31; 98/32; 98/52; 34/73; 34/235; 62/285

[58] Field of Search ..... 98/31, 32, 6, 51, 52, 98/55; 34/235, 73, 78; 62/285, 288, 405

[56] References Cited

U.S. PATENT DOCUMENTS

| | | | |
|---|---|---|---|
| 2,216,873 | 10/1940 | Browne | 98/51 X |
| 2,338,363 | 1/1944 | Strobell | 98/6 |
| 2,645,824 | 7/1953 | Titsworth | 220/426 X |
| 2,782,705 | 2/1957 | Breidert | 98/55 |
| 2,988,980 | 6/1961 | Tschudin | 98/31 X |
| 3,118,559 | 1/1964 | Stricker, Jr. | 98/31 X |
| 3,515,051 | 6/1970 | Pulcrano | 98/6 |
| 3,789,747 | 2/1974 | Wasserman et al. | 98/31 X |
| 4,143,588 | 3/1979 | Exler | 98/52 X |
| 4,169,407 | 10/1979 | Dorpmund | 98/52 X |

*Primary Examiner*—William E. Tapolcai, Jr.

[57] ABSTRACT

A self-venting cargo container for transporting temperature and moisture sensitive cargo having a tight enclosure for retaining bulk cargo with one of the end walls being openable for loading and unloading cargo and side walls which have longitudinally-extending and outwardly projecting moldings with each side wall having at least one section for admitting and exhausting air into and out of said container. Each of the side wall sections having an upper portion with a series of openings and an intermediate portion with a series of openings for air passage therethrough. Baffle means are secured to each section directly above the openings in the upper and intermediate portions of the side wall sections forming a canopy over the openings to exclude rain water and sea water from entering the openings in the side wall sections. A vent cover is provided in which the upper and lower sections have a substantial number of openings for air flow therethrough with the vent cover being secured to each side wall in overlapping relation with each side wall section to form a vertical chamber and a bottom condensate drain opening at the bottom to drain collected water. A drip molding is provided in the container interior that extends longitudinally along the side walls inwardly from said openings in the side wall sections at the intermediate level for draining any condensate collected in the container through the openings in the intermediate level of each side wall section for flow into the vertical chamber.

4 Claims, 4 Drawing Figures

SELF-VENTING CARGO CONTAINER

BACKGROUND OF THE INVENTION

Transportation of bulk cargo from warm humid climates to temperate zones having lower temperatures and humidity usually results in moisture condensation within the container interior caused by temperature differences between the interior and exterior of the container particularly when the cargo is loaded at elevated temperature and humidity conditions. Condensed water will be deposited on the cargo when the temperature and humidity differences will produce condensation inevitably resulting in claims due to water damage, mold growth, and oxidation depending upon the nature of the bulk cargo being shipped.

As one example of a persisting problem that has occurred due to inadequate ventilation is the experience with condensation experienced when transporting cocoa beans from Caribbean locations to North America. Other commodities will produce similar problems when the bulk cargo may readily experience a loss of moisture to the environment within the interior of a container that is sealed and lacks suitable ventilation. The water or moisture usually condenses on the interior of the container on the roof and side walls eventually precipitating on the product, such as cocoa beans causing stains, mold, growth and other damage that inevitably leads to losses and the filing of claims.

In the conventional sealed cargo container, a "pumping" cycle occurs and functions whenever the ambient temperature falls below that of the cargo load which usually has a temperature ranging from 80 to 90 degrees F. The "pumping" cycle is the occurrence of air currents that circulate above the cargo and beneath the roof of the container when the ambient air is lower than the temperature of the product which contains moisture at the elevated temperature level. By reference to a psychometric chart, one may readily determine the relative humidity at prescribed temperatures and dry bulb and wet bulb conditions. When cooler air permeates the atmosphere, the temperature of the roof and sides of the container will be lowered promoting the conditions requisite for condensation to occur. As the cooler air settles on the top of a load of product where the temperature and relative humidity are higher, the cool air in the container will be warmed and the relative humidity decreased which permits the air to accept additional moisture from the cocoa beans. This warm moist air rises and contacts the cooler container surfaces where condensation occurs. This cycle will repeat itself depending upon the conditions that prevail throughout the transportation of the cocoa beans, and substantial quantities of condensate on the roof and walls precipitate on the product resulting in stains, damage and other deleterious effects prior to unloading.

Attempts have been made to overcome the condensation problems by numerous methods and structures including the provision of forced circulation of which U.S. Pat. No. 4,143,588 is but one example of an active system and U.S. Pat. No. 3,319,349 exemplifies another system that is passive. Both systems illustrated in the aforementioned patents and others are costly to install and may require substantial expenditures for new installation.

SUMMARY AND OBJECTIVES OF THE INVENTION

One of the main objects of the present invention is to provide a conventional cargo container, preferably by retrofitting, which may be transported on any type of vessel or be mounted on any vehicle which will eliminate the necessity for forced or active means for ventilating the cargo container interior to prevent or inhibit the deleterious effect from condensation resulting from temperature and humidity variations of the cargo and ambient conditions that may vary daily as well as over a period necessary for transportation of the cargo.

Furthermore, the present invention permits the utilization of the presently existing container units in which the cargo container is self-ventilated passively without reducing the pay load volume while maintaining a water-tight protected cargo and one in which there is no requirement for modifying the positioning, loading, off-loading or maintenance of the cargo container.

Basically, the present invention modifies existing cargo containers by modifying portions of the side walls to induce a chimney effect resulting in self-ventilation of the cargo container above the bulk cargo while protecting the bulk cargo from spoilage by rain, sea spray or green water, eliminating or greatly reducing claims for spoilage, damage, oxidation and other deleterious effects resulting from condensation. The condensation flows down the side walls and drains through openings that are provided in the side walls and in sections through which the water may drain from the individual containers while protecting the cargo.

The provision of the self-venting units positioned on the container exterior does not reduce the interior volume or loading capacity. Furthermore, the improved structure does not affect container handling and requires no manual intervention to activate the system.

BRIEF DESCRIPTION OF THE DRAWING

A preferred embodiment of the invention is referred to in the appended drawing which illustrates, without limitations, the present concept, and in which.

DESCRIPTION OF A PREFERRED EMBODIMENT

Figure 1:
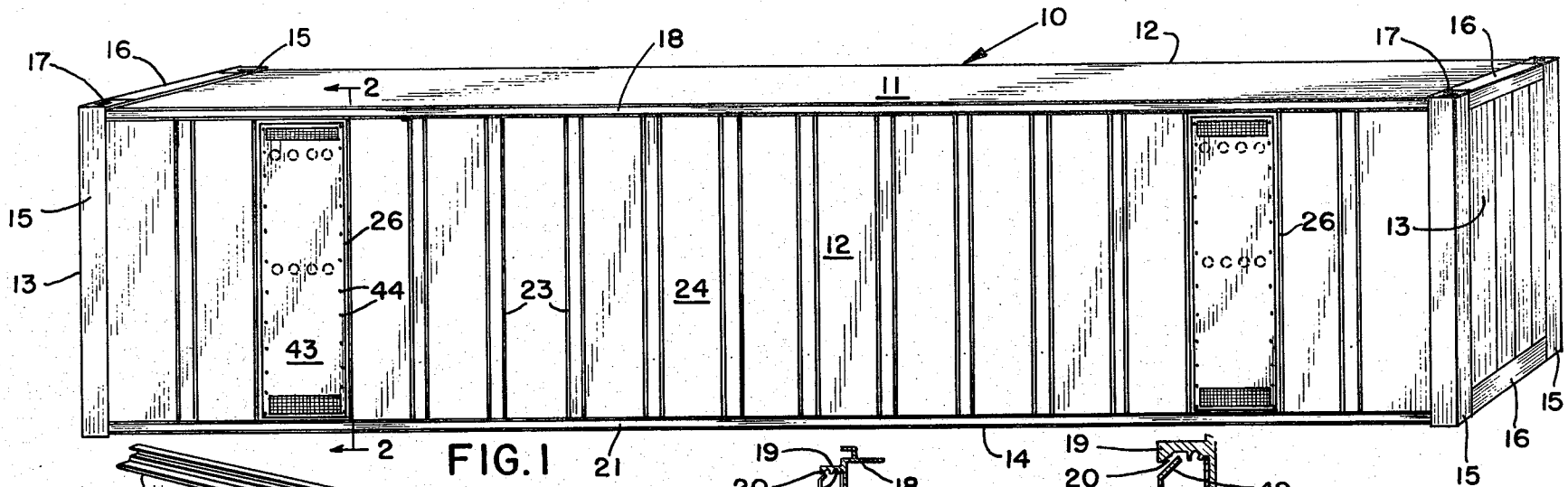
FIG. 1 is a perspective view of a cargo container incorporating the self-vented sections in the side walls with only one side wall being shown.
Figure 3:
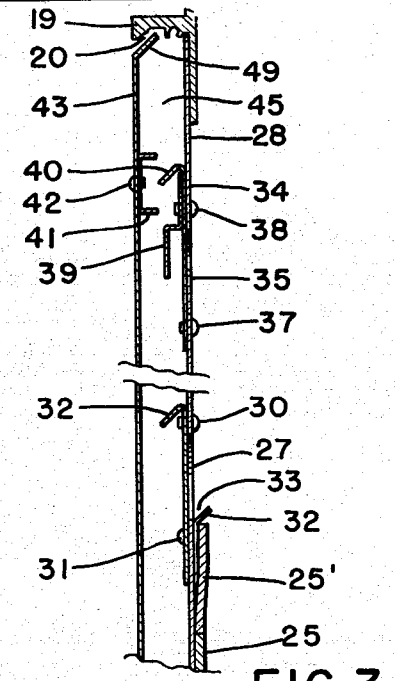
FIG. 3 is an enlarged portion of FIG. 2.
Figure 2:
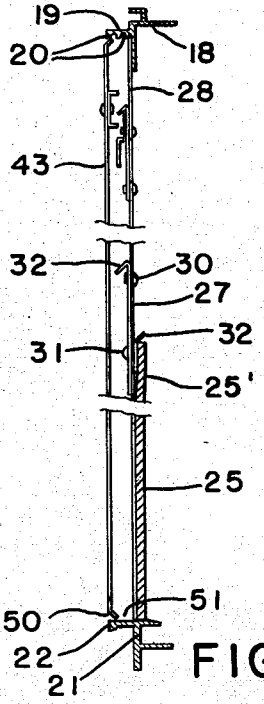
FIG. 2 is an enlarged partial transverse sectional view taken along section line 2—2 of FIG. 1.
Figure 4:
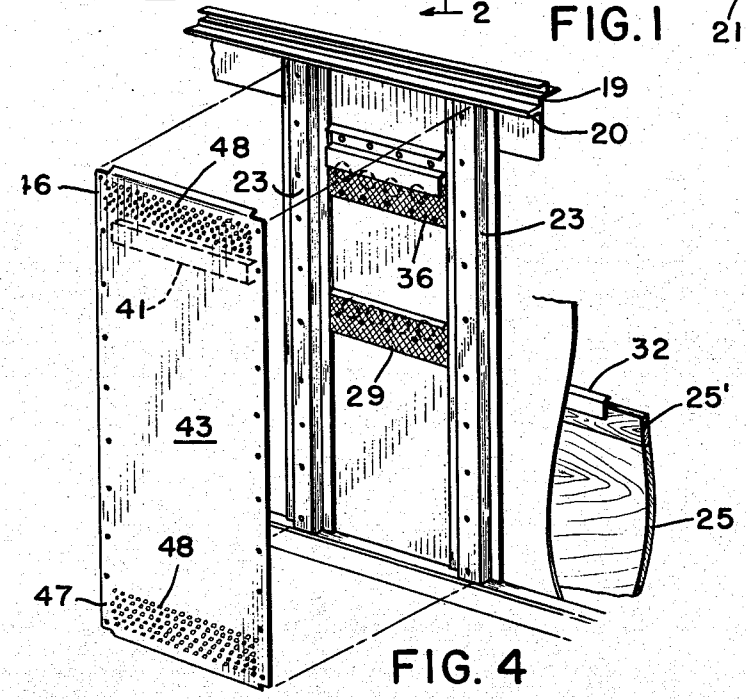
FIG. 4 is a partial exploded view of one section of a side wall incorporating, in perspective, the various components in the structural modifications.

Referring to the drawing and particularly to FIG. 1, there is illustrated a cargo container 10 of conventional construction of the type disclosed in U.S. Pat. No. 3,027,025 and others of Keith W. Tantlinger in which container 10 has a top wall or roof 11, a pair of side walls 12 only one of which is shown, end walls 13, only one of which is shown, a bottom wall or load-supporting. Suitable lift openings 17 are provided in the corner posts 15, and the container 10 may be stacked in conjunction with similar containers of comparable length. One end wall 13 is suitably hinged for opening and closing to permit cargo loading and unloading.

Longitudinally-extending extrusion 18 is secured to the top of each side wall 12 and is provided with a projecting flange 19 having a pair of spaced indentations 20 facing downwardly. A bottom longitudinally-extending extrusion 21 is also secured to each of the side walls 12 and has a projecting flange 22 substantially parallel and coextensive with flange 19.

Each of the side walls 12 has a series of vertical stringers or studs 23 that are laterally spaced from each other and extend from the platform 14 to the roof or top wall 11. The exterior of the container is enclosed by aluminum sheets 24 suitably secured by rivets or welding to provide a water-tight enclosure. The container interior is of conventional construction also and is provided with either a metal or wooden deck depending upon the nature of the cargo to be transported. In the cargo containers for shipping bulk cargo such as cocoa beans, side panels of ¼ inch plywood 25 extend about the container interior to a height of approximately four feet above which a plywood panel section 25' that is six inches wide may be added to be above the top level of the bags or sacks of cocoa beans.

Each side wall 12 is provided preferably with at least two sections 26 which are substantially identical, and only one of which will be described and shown in detail, for achieving self-ventilation of the container interior in a passive manner promoting condensation to be reduced and removing condensate collected through a series of openings 27 provided intermediate the length of the side panel 28 in section 26. The intermediate openings 27 have a diameter of approximately 3¼ inches and four such intermediate openings 27 are laterally spaced in alignment in the panel 28. A prescribed reticulated screen 29 is securely fastened over the openings 27 by rivets 30 and 31 with the screen 29 being provided with a baffle or canopy drip molding 32 to prevent water entering into openings 27 from above. A drip molding 32 extends longitudinally in the container interior and is secured by rivets 31 and the panel 25' whereby any condensate that may drip from the side walls on the interior of the container will be induced to flow into the trough 33 formed by the drip molding 32 and the interior of the side wall 12 with the condensate collected in the trough 33 escaping through the openings 27, the bottom of which openings communicate with the trough 33.

The upper portion 34 of panel 28 is also provided with a series of openings 35 similar to the openings 27 with four such openings having a diameter of 3¼ inches being arranged in the panel 28. A reticulated screen 36 of prescribed construction for meeting tamper proof requirements is secured by rivets 37 and 38 over the upper openings 35. A baffle or canopy member 39 is also secured by rivets 38 and extends downwardly to prevent any downward flow of water from entering into opening 35 from the exterior of the container. A deflector member 40 is formed at the upper portion of the baffle member 39 which assists in deflecting any water downflow in conjunction with the channel member 41 that is secured by the rivet 42 to the cover panel 43 that is securely fastened by rivets 44 to the vertical reinforcing studs 23 forming a vertical chamber 45 between the panels 28 and 43. The upper and lower portions 46 and 47 of vent cover or panel 43 includes sections having a substantial number of drilled holes 48 which may be replaced by a suitable protective and tamper proof screen for the free flow of air at the top and bottom sections 46 and 47 providing for a free flow of air upwardly from the openings 48 in section 47 through the openings 48 in section 46 induced by a chimney effect.

An inturned edge 49 in the vent cover 43 cooperatively fits into the groove 20 in flange 19 of the molding 18 to protect against a downward flow of water into the chamber 45 from the flange 19. The lower edge 50 of the vent cover 43 is also turned inwardly and is in spaced relation to the flange 22 forming a drain opening 51 for condensate discharged into the chamber 45 or any water that may pass through the openings 48. Inturned or angled edges 49 and 50 increase panel stiffness which will resist bending and warping of the panel 43 in the vertical plane.

The self-vented sections in the side walls are designed to permit cooler and drier ambient air to be introduced into the container interior for reducing the total amount of water available for condensation thereby decreasing the temperature differential between the interior and exterior of the container. The passive chimney-type vent functions both in calm and windy environments primarily as a result of the temperature gradients as well as prevailing wind conditions. The chimney vents meet TIR specifications by precluding access passageways between the interior and exterior of a container while maintaining it water-tight and preventing rain, spray and green water from entering the container.

The effectiveness of the passive self-vented system with the number of sections in each side wall may depend upon the type of cargo which may include cargos with high specific heats including scrap metal, machine parts, machinery, canned food products, etc., and the volume of air exchange will vary although some condensation may form initially when moving from a dry, cool climate to a warm, humid environment. The long term effect will be reduced appreciably due to a lessening of the temperature differential between the interior and exterior of the container and the high level of air exchange which will be induced to evaporate any condensate that may tend to form.

The invention for a self-vented cargo container described in the foregoing preferred embodiment may be varied within the scope of the claims.

We claim:

1. A self-venting cargo container for handling temperature and moisture sensitive cargo having bottom, top, side and end walls forming a tight enclosure for retaining bulk cargo therein, one of said end walls being openable for loading and unloading cargo, each of said side walls having at least one self-venting section for admitting and exhausting air into and out of said container, each of said sections having upper, intermediate and lower portions, said upper portion of each section having a series of openings and said intermediate portion having a series of openings for passage therethrough of water condensed from inside the container, baffle means secured to each section above said openings in said upper and intermediate portions to exclude downward water flow from entering said openings, a vent cover having upper, intermediate and lower sectors, said upper and lower sectors of said vent cover having a plurality of openings for air flow therethrough, each of said vent covers being secured in overlapping relation with each of self-venting sections forming a vertical chamber therebetween and a bottom drain opening whereby a chimney effect for induced draft occurs in said vertical chamber producing air circulation vertically in said chamber and into said container to modify the temperature gradient between the container interior and exterior to reduce condensation within the container.

2. A self-venting cargo container as claimed in claim 1, each of said side walls having top and bottom wall longitudinally-extending molding having flanges projecting from said side walls, said vent covers having upper and lower inwardly turned edges, said upper vent cover edge cooperatively positioned in said top molding flange to deflect water downflow and said lower inwardly turned edge being spaced from said bottom molding forming said drain opening.

3. A self-venting cargo container as claimed in claim 1, said side walls each having an interior longitudinally-extending wall, a horizontal drip molding secured to said interior side walls in juxtaposition with said openings in said intermediate portion of said sections whereby condensate collected by said horizontal drip molding will flow through said openings in said intermediate portion outwardly into said vertical chamber and downwardly through said drain opening.

4. A self-venting cargo container as claimed in claim 1, and reticulated screens securely fastened over said series of openings in each of said sections.

* * * * *